US005439281A

United States Patent [19]

Croker

[11] Patent Number: 5,439,281

[45] Date of Patent: Aug. 8, 1995

[54] STORAGE SYSTEM

[75] Inventor: John C. Croker, Farmington Hills, Mich.

[73] Assignee: Denstor Mobile Storage Systems Inc., Farmington Hills, Mich.

[21] Appl. No.: 107,272

[22] Filed: Aug. 16, 1993

[51] Int. Cl.[6] ..... A47B 53/00

[52] U.S. Cl. ..... 312/201; 104/245

[58] Field of Search ..... 312/201, 198; 104/245, 104/246, 166

[56] References Cited

U.S. PATENT DOCUMENTS

| | | | |
|---|---|---|---|
| 1,323,511 | 12/1919 | Welch . | |
| 1,694,528 | 12/1928 | Clarkson . | |
| 1,858,086 | 5/1932 | House . | |
| 2,590,040 | 3/1952 | Rose . | |
| 2,836,129 | 5/1958 | Jaeger . | |
| 2,915,195 | 12/1959 | Crosby . | |
| 3,094,363 | 6/1963 | Fremstad et al. . | |
| 3,180,280 | 5/1965 | Kuch | 104/245 |
| 3,535,009 | 10/1970 | Cain . | |
| 3,558,152 | 1/1971 | Miles et al. . | |
| 3,567,299 | 3/1971 | Lundqvist . | |
| 3,724,389 | 4/1973 | Greaves . | |
| 3,782,293 | 1/1974 | Donohue | 104/245 |
| 3,801,176 | 4/1974 | Higbee . | |
| 3,967,868 | 7/1976 | Baker, Jr. . | |
| 4,092,031 | 5/1978 | Greer et al. . | |
| 4,192,564 | 3/1980 | Losert . | |
| 4,418,627 | 12/1983 | Baker . | |
| 4,597,615 | 7/1986 | Steger . | |

FOREIGN PATENT DOCUMENTS

| | | | |
|---|---|---|---|
| 1227701 | 8/1990 | France | 104/245 |

*Primary Examiner*—Kenneth J. Dorner
*Assistant Examiner*—Gerald A. Anderson
*Attorney, Agent, or Firm*—Harness, Dickey & Pierce

[57] ABSTRACT

A movable storage system has one or more storage units, a plurality of flexible track elements conformable with an irregular supporting surface, and an individual base structure which supports each storage unit for movement along the track elements through roller members associated with particular track elements. The flexible track elements have a pair of cylindrical longitudinally extending track members supported by a flexible base. The roller members or wheels have a generally U-shaped external contour which encompasses the track elements and prevents derailing of the storage units.

20 Claims, 3 Drawing Sheets

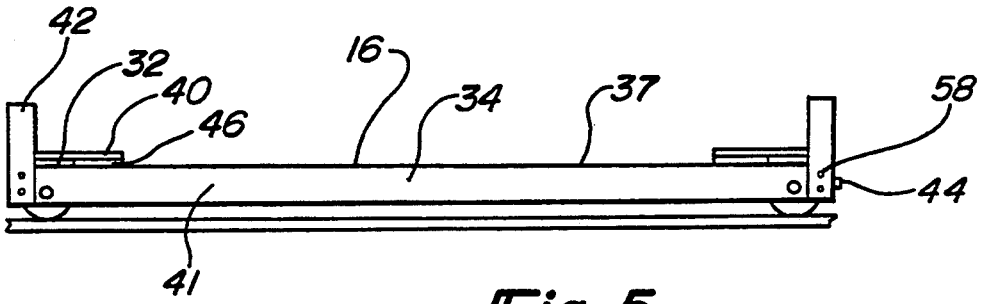
Fig-5
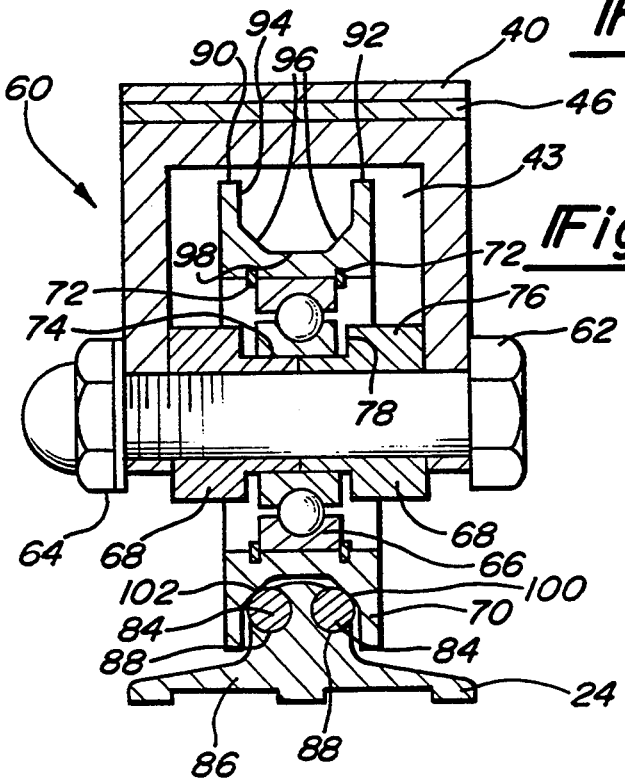
Fig-6
Fig-7
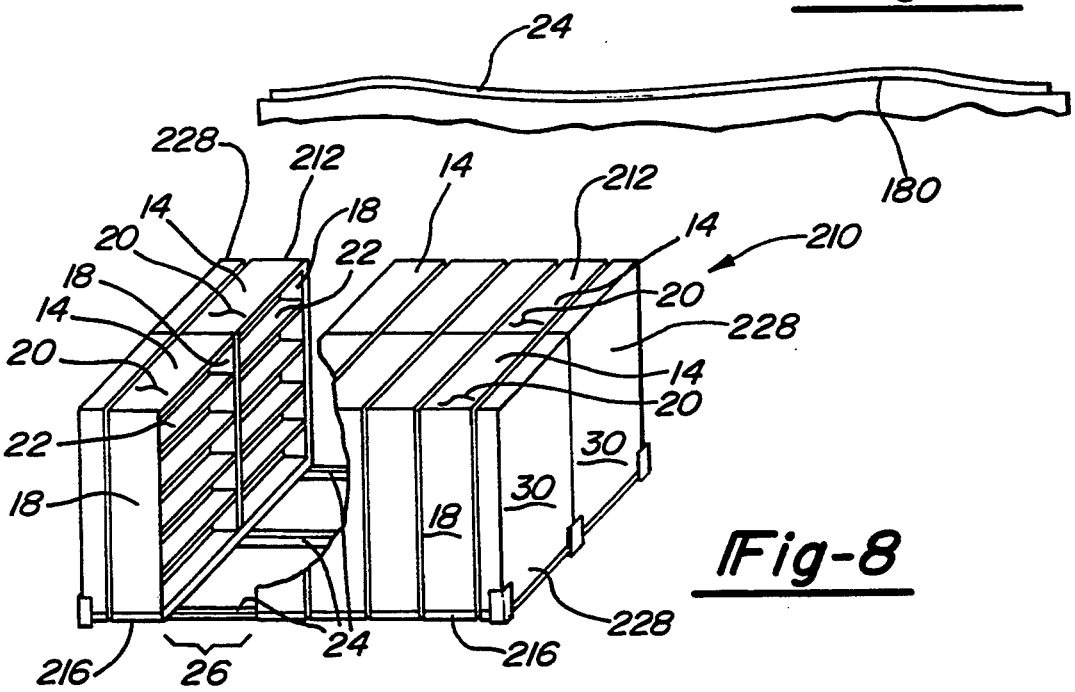
Fig-8

STORAGE SYSTEM

BACKGROUND OF THE INVENTION

The present invention relates to high density storage systems of the type having a plurality of individual movable storage units. More particularly, the present invention relates to an improved design for the wheel and tracks for the high density storage system.

High density storage systems have typically consisted of rows of storage sections. Each row is supported upon a common base and is movable upon spaced parallel tracks through the provision of roller mechanisms or the like. The length of the parallel tracks are roughly equal to the total dimension of the various storage units when they are placed directly adjacent one another, plus the width of an access aisleway through which a person may have access to the individual shelf sections. These prior art high density storage systems thus enable access to various individual storage sections as desired while minimizing space requirements for the overall system.

The designs of certain of such prior high density systems have, however, certain disadvantages due to the designs of the wheels, the tracks and the interface between these two components. The wheels which ride along and mate with the track exhibit a tendency to derail from the track under various movements of the individual storage units. This tendency is more prevalent in both the heavy duty designs of storage systems as well as when the system requirements dictate a relatively thin or minimal depth storage unit.

Prior art designs of wheel and track members are shown in FIGS. 1 and 2. Both of these wheel and track systems are designed to utilize tracks which reduce the need to provide accurate leveling of the track so the system may be utilized on relatively irregular support surfaces. FIG. 1 shows a wheel 110 rotatably mounted to an axle 112 and positioned on the axle by a pair of bushings 114. The exterior surface 116 of the wheel 110 is adapted to mate with the track 118 as shown in FIG. 1. Track 118 consists of a generally triangular base 120 having a cylindrical running surface 122 disposed within the triangular base 120 as shown in FIG. 1. While this configuration is acceptable for certain applications, this design has a tendency to easily derail when any type of side load is generated between the wheel and the track. The presence of a side load easily ramps the wheel 110 up and over one of the angular surfaces of the triangular track 118.

FIG. 2 shows another type of prior art wheel and track design. In this design, a wheel 130 is rotatably mounted to an axle 132 and positioned on the axle by a pair of bushings 134. The exterior surface 136 of the wheel 130 is generally cylindrical. The track 138 consists of a generally triangular base 140 but instead of incorporating a cylindrical running surface similar to FIG. 1, base 140 has a longitudinally running generally V-shaped groove 142. The V-shaped groove has a pair of inserts 144 which run the entire length of the track 138. These inserts provide a pair of running surfaces for the wheel 130. The wheel 130 contacts the inserts 144 at points 146 and 148. This design of track, while improving on the problem of derailment, does not eliminate the derailment issue. Due to the relatively shallowness of the V-shaped groove, the wheel can still be relatively easily derailed from the track.

It is, therefore, desirable to provide a new and improved high density storage system which incorporates a wheel and track system which is less sensitive to the tendency of the storage unit to derail. It is further desirable to provide such a stable high density storage system which also reduces the need to provide accurate leveling of the associated tracks upon which the storage units are supported and guided for movement so that the system may be utilized on relatively irregular support surfaces.

The above and other features of the invention will become apparent to those skilled in the art from the subsequent detailed description, appended claims and drawings.

DESCRIPTION OF THE DRAWINGS

FIG. 5 is an end view of the base structure shown in FIG. 4.

FIG. 6 is a cross-sectional view taken in the direction of Line 6—6 of FIG. 4 and shows a typical corner wheel assembly.

FIG. 7 is a schematic representation of a portion of the track system of the present invention.

FIG. 8 is a perspective view, partially broken away, of a high density storage system in accordance with another embodiment of the present invention.

DETAILED DESCRIPTION OF THE PREFERRED EMBODIMENT

Figure 1:
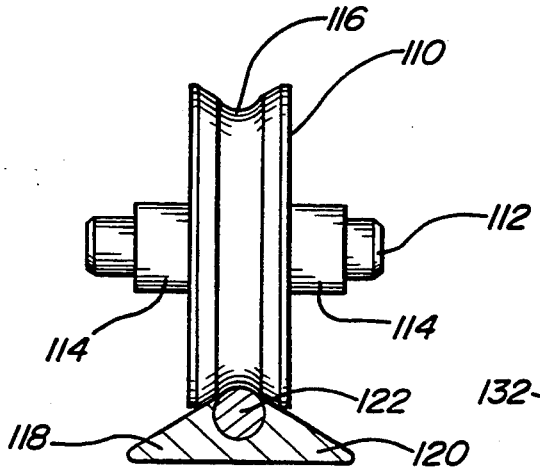
Fig-1 PRIOR ART
FIG. 1 is an end view partially in cross-section showing a prior art wheel and track assembly.
Figure 2:
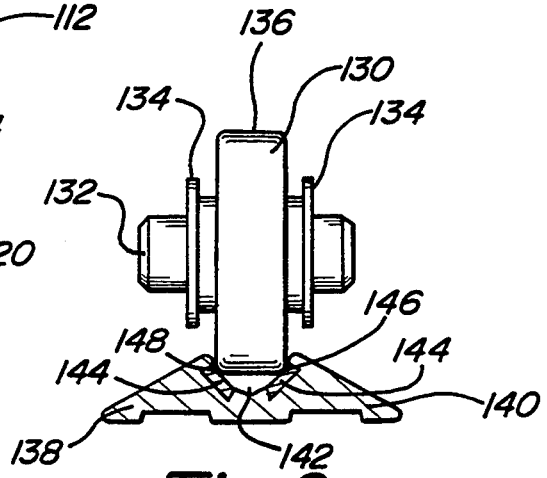
Fig-2 PRIOR ART
FIG. 2 is an end view partially in cross-section showing another prior art wheel and track assembly.
Figure 3:
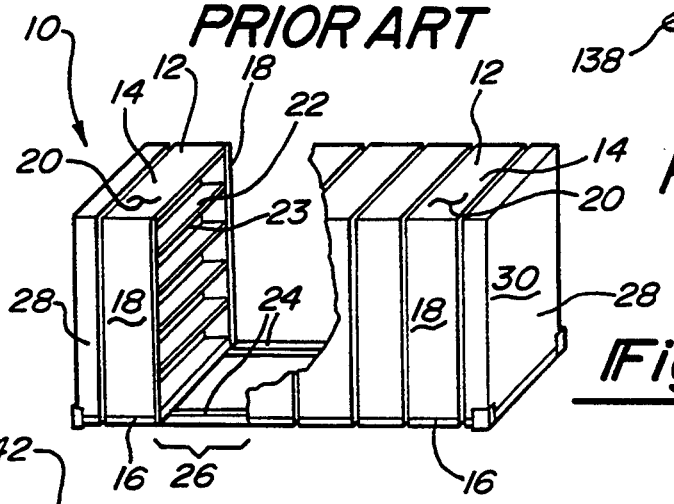
FIG. 3 is a perspective view, partially broken away, of a high density storage system in accordance with the present invention.

Referring now to the drawings, a high density storage system in accordance with the present invention is shown in FIG. 3 and is designated by the reference numeral 10. Storage system 10 includes a plurality of movable storage units 12 arranged generally in an aligned relationship. Each of the storages units 12 includes a shelf section 14 having an associated supporting base 16. Each of the individual storage sections 14 comprises a pair of spaced apart sidewalls 18 and an upper or top portion 20, as well as a plurality of horizontally extending shelves 22 operable to provide for individual storage stations 23 in each storage section 14. Each of the storage units 12 is adapted to be moved along a generally linear path defined by a plurality of tracks 24. The length of tracks 24 is generally equal to the width of a typical aisleway 26 through which a person may have access to particular storage sections 14, and the sum of the overall width of each of the movable storage units 12 when such units 12 are disposed directly adjacent to each other. Storage system 10 can also be optionally provided with a pair of fixed storage units 28 disposed at the opposite ends of system 10 and having stationary storage sections 30.

Figure 4:
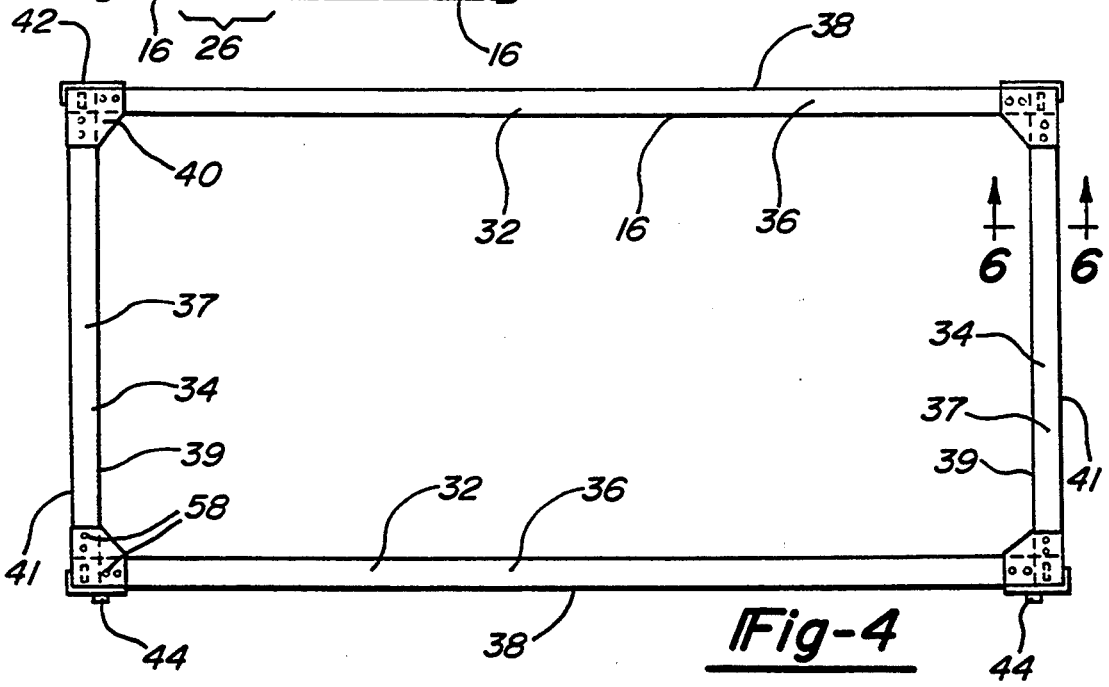
FIG. 4 is a top view of the base structure for each movable storage unit shown in FIG. 3.

Individual base structure 16 for each of storage sections 14 is shown more fully in FIGS. 4 and 5. Each base structure 16 includes a pair of longitudinally extending spaced generally parallel frame members 32 of a length roughly equal to that of its associated storage section 14. Transversely extending parallel end frame members 34 of a length roughly equal to the width of storage section 14 communicate between the ends of frame members 32. Each of frame members 32 comprises a generally right angle channel consisting of an elongated top portion 36 and a vertically depending side portion 38 oriented on an exterior or exposed side of base structure 16. Each of frame members 34 comprises a generally U-shaped channel consisting of an elongated top portion 37 and a pair of vertically depending side portions 39 and 41 extending downward from top portion 37 and cooperating therewith to define an elongated channel 43 extending between frame members 32 as shown in FIG. 6. The adjacent ends of respective frame members 32 and 34 are matingly assembled with a corner gusset 40 and a corner bracket 42. Corner gusset 40 is matingly assembled with frame members 32 and 34 by threaded fasteners 58 which are received through top portions 36 of frame members 32 and top portions 37 of frame members 34. A spacer 46 accommodates for the differences in height between top portions 36 and top portions 37. Corner brackets 42 are also matingly assembled with frame members 32 and 34 by threaded fasteners 58. Corner brackets 42 extend above top portions 36 and top portions 37 and are used to facilitate proper orientation and positioning of individual storage sections 14 for support on and movement with base structure 16. A bumper 44 is attached to corner brackets 42 located on one side of frame 16 and is used to cushion the contact between adjacent storage units 12 during movement.

Base structure 16 includes a corner wheel assembly 60 disposed at each of the four corners of base structure 16. One such corner wheel assembly 60 is illustrated in FIG. 6 and comprises a bolt 62, an acorn nut 64, a bearing 66, a pair of bushings 68 and a wheel 70. Bearing 66 is press fit into the inside diameter of wheel 70. A retaining ring 72 is located on each side of bearing 66 to insure that bearing 66 will not move axially with respect to wheel 70. The pair of bushings 68 have a first cylindrical portion 74 and a second cylindrical portion 76 which forms a shoulder 78. First cylindrical portion 74 is disposed within the inside diameter of bearing 66. The height of first cylindrical portion 74 is such that when a bushing 68 is placed on opposite sides of bearing 66 with first cylindrical portion 74 being disposed within the inside diameter of bearing 66, the width between the opposed shoulders 78 is slightly larger than the width of bearing 66. This provides for a small axial movement of the bearing 66 and wheel 70 relative to bushings 68. This small movement helps to accommodate slight irregularities in the track installation.

Wheel 70 has an exterior surface 90 which has a generally U-shaped cross-section. Exterior surface 90 comprises a pair of cylindrical surfaces 92, a pair of opposed vertical surfaces 94, a pair of opposed angular surfaces 96 and a generally cylindrical bottom surface 98. Wheel 70 is operative to receive and be supported for movement by an associated track section 24, which, as shown in FIG. 6, comprises a pair of cylindrical hardened steel track members 84 and a hat shaped aluminum base 86. Steel track members 84 may be made from various compositions of steel including stainless steel in order to meet the requirements of specific applications. The hat shaped aluminum base 86 has a pair of partially cylindrical pockets 88 which extend along the entire length of track 24 for receiving and supporting the hardened steel track members 84. The cross sectional shape of exterior surface 90 of wheel 70 is correlated with the width of track 24 so that the pair of cylindrical stainless steel track members 84 will contact along the pair of opposed angular surfaces 96 in generally line contact, as indicated in FIG. 6 at 100 and 102. Such line contact between the pair of opposed angular surfaces 96 of wheel 70 and track 24 minimizes frictional resistance to rolling movement of wheel 70 along track 24. The opposed vertical surfaces 94 extend downward over track 24 and insure that wheel 70 will not derail from track 24 during movement of storage units 12.

As so designed, the high density storage system 10 of the present invention can be utilized by mounting respective storage sections 14 directly upon the upper side of the individual base structures 16 and properly orientating and positioning each such storage section 14 upon its base structure 16 by way of corner brackets 42 of base structure 16. When a user desires to obtain access to any particular storage section 14, wheel assemblies 60 of base structure 16 enable the remaining storage sections 14 to be moved along their associated tracks 24 to define and provide a desired access aisleway 26. The shape and construction of each of tracks 24 is such that it is relatively flexible and deformable and therefore specifically suited to conform with the supporting surface upon which it is mounted, even though such surface may be of a relatively irregular profile. In this regard, reference is made to FIG. 7 wherein an exemplary track 24 is schematically illustrated mounted upon a relatively irregular support surface 180, which is shown in an exaggerated manner for illustrative purposes only. Track 24 will conform with such irregularities so as to obviate the need and expense of providing an extremely level surface and/or providing an ancillary support system between an irregular support surface and a relatively rigid track system. One of the significant reasons that tracks 24 can be utilized on such relatively irregular surfaces such as 180 resides in the fact that the various storage sections 14 and their associated individual base structure 16 will move over a relatively short portion of the total length of any particular track 24. The flexible and compliant nature of track 24 thus only requires that an irregular profile over a limited distance be negotiated by any one base structure to provide the necessary access aisleway 26 to a particular storage section 14. An extremely high density storage system is thus achieved which enables individual access to particular units 14 in a relative effortless manner.

The above described high density storage system operates effectively for storage units which have a length which is less than approximately eight feet. When a high density storage system is required to have a width which is greater than approximately eight feet, the storage system as shown in FIGS. 8–11 is utilized. Components shown in FIGS. 8–11 which are the same as those shown in FIGS. 3–6 have been given the same reference numerals.

FIGS. 8–11 illustrate another embodiment of a high density storage system which is designated by the reference numeral 210. System 210 is similar to the system illustrated in FIGS. 3–6 except that the storage units are doubled on the frame and a transversely extending frame member has been added. In addition, a third track has been added to the middle of the storage system to accommodate the wheels associated with the additional frame member. Storage system 210 includes a plurality of movable storage units 212 arranged in both a side to side and generally in an aligned relationship. Each of storage units 212 includes a pair of shelf sections 14 and each side to side pair of shelf sections 14 has an associated support base 216. Each of the individual storage sections 14 comprises a pair of spaced apart sidewalls 18 and an upper or top portion 20, as well as a plurality of horizontally extending shelves 22 operable to provide for individual storage sections 14. Each of the storage units 212 is adapted to be moved along a generally linear path defined by a plurality of tracks 24. The length of tracks 24 is generally equal to the width of a typical aisleway 26 through which a person may have access to particular storage sections 14, and the sum of the overall width of each of the movable storage units 212 when such units 212 are disposed directly adjacent to each other. Storage system 210 can also be provided with a pair of fixed storage units 228 disposed at the opposite ends of the system 210 and having stationary storage sections 30.

Figure 9:
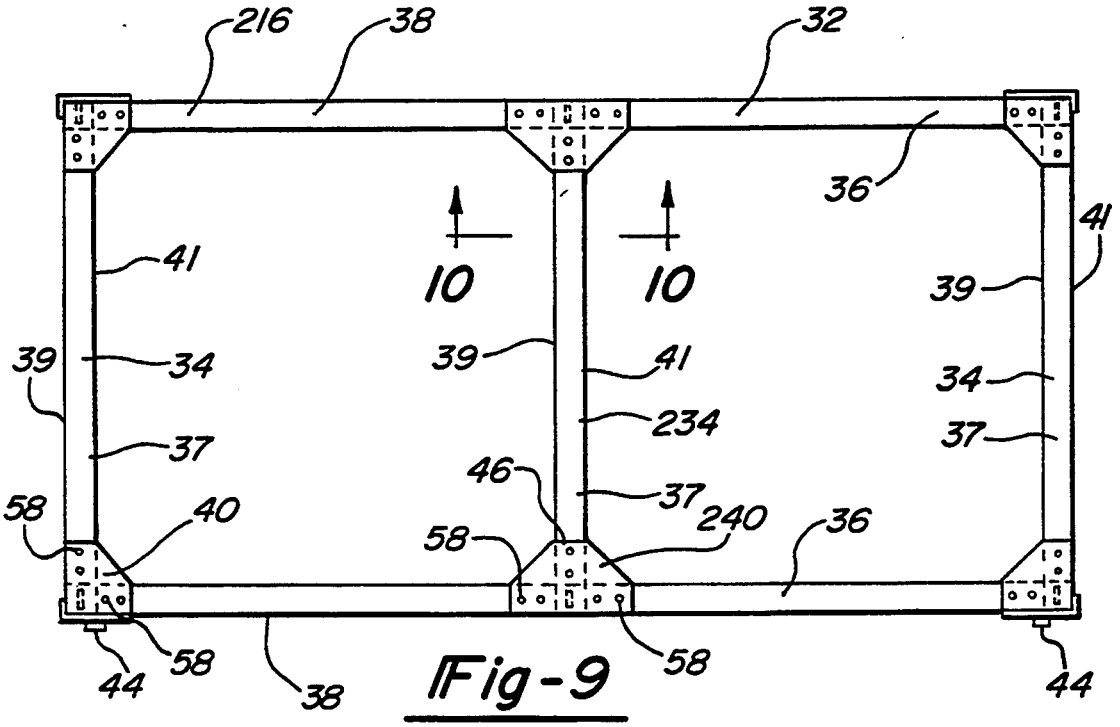
FIG. 9 is a top view of the base structure for each movable storage unit shown in FIG. 8.
Figure 10:
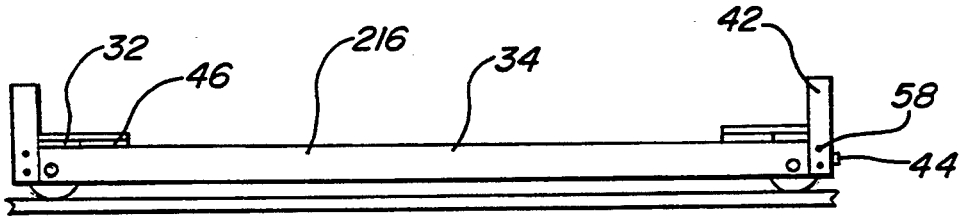
FIG. 10 is an end view of the base structure shown in FIG. 8.
Figure 11:
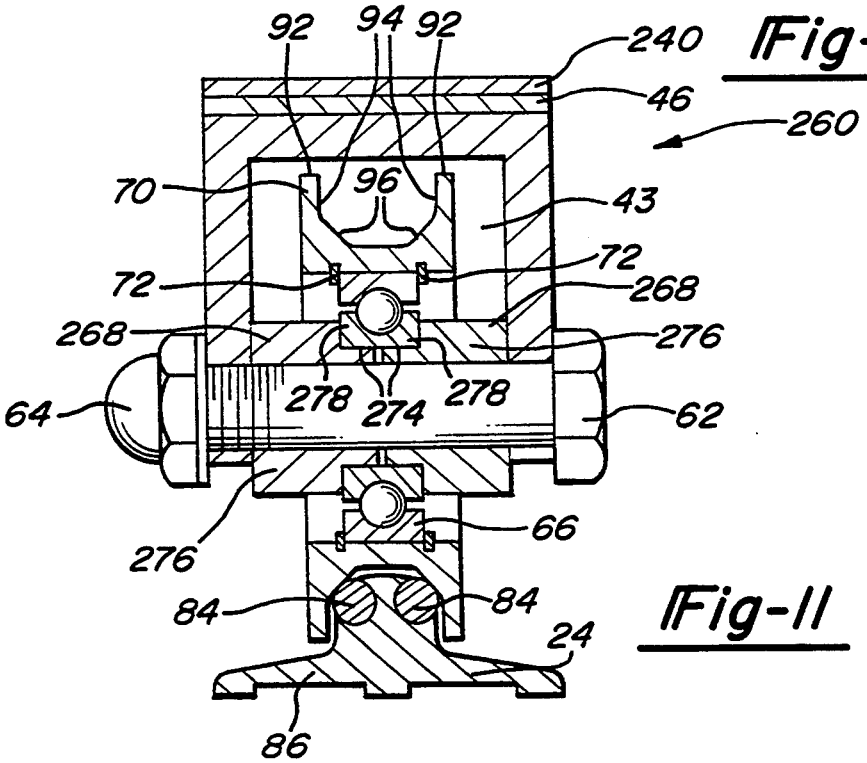
FIG. 11 is a cross-section view taken in the direction of Line 10—10 of FIG. 8 and shows a typical center wheel assembly.

Individual base structure 216 for each pair of storage sections 14 is shown more fully in FIGS. 9 and 10. Each base structure 216 includes a pair of longitudinally extending spaced generally parallel frame members 32 of a length roughly equal to that of its associated pair of storage sections 14. Transversely extending parallel end and middle frame members 34 and 234 respectively of a length roughly equal to the width of a storage section 14 communicate between the ends and middle of frame members 32. Each of frame members 32 comprises a generally right angle channel consisting of an elongated top portion 36 and a vertically depending side portion 38 oriented on an exterior or exposed side of base structure 216. Each of frame members 34 and 234 comprises a generally U-shaped channel consisting of an elongated top portion 37 and a pair of vertically depending side portions 39 and 41 extending downward from top portion 37 and cooperating therewith to define an elongated channel 43 extending between frame members 32 as shown in FIG. 11. The adjacent ends of respective frame members 32 and 34 are matingly assembled with a corner gusset 40 and a corner bracket 42. Corner gusset 40 is matingly assembled with frame members 32 and 34 by threaded fasteners 58 which are received through top portions 36 of frame members 32 and top portions 37 of frame members 34. A spacer 46 accommodates for the differences in height between top portions 36 and top portions 37. Corner brackets 42 are also matingly assembled with the frame members 32 and 34 by a plurality of threaded fasteners 58. Corner brackets 42 extend above top portions 36 and top portions 37 and are used to facilitate proper orientation and positioning of the individual pairs of storage sections 14 for support on and movement with base structure 216. A bumper 44 is attached to corner brackets 42 located on one side of frame 216 and is used to cushion the contact between adjacent storage units 212 during movement. Middle frame member 234 is located approximately midway between and parallel with end frame members 34 and is supported by a mid-rail gusset 240. Mid-rail gusset 234 is matingly assembled with frame members 32 and 234 by a plurality of threaded fasteners 58 which are received through top portions 36 of frame members 32 and top portions 37 of frame member 234. A spacer 46 accommodates for the differences in height between top portions 36 and top portions 37.

Base structure 216 includes a corner wheel assembly 60 disposed at each of the four corners of base structure 216. This corner wheel assembly is identical to the corner wheel assembly described above and illustrated in FIG. 6.

Base structure 216 also includes a mid-rail wheel assembly 260 disposed at each end of middle frame member 234. Mid-rail wheel assembly 260 is illustrated in FIG. 11 and comprises a bolt 62, an acorn nut 64, a bearing 66, a pair of bushings 268 and a wheel 70. Bearing 66 is press fit into the inside diameter of wheel 70. A retaining ring 72 is located on each side of bearing 66 to insure that bearing 66 will not move axially with respect to wheel 70. The pair of bushings 268 have a first cylindrical portion 274 and a second cylindrical portion 276 which forms a shoulder 278. First cylindrical portion 274 is disposed within the inside diameter of bearing 66. The height of first cylindrical portion 274 is such that when bushing 268 is placed on opposite sides of bearing 66 with first cylindrical portion 274 being disposed within the inside diameter of bearing 66, opposed shoulders 278 contact the inner race of bearing 66 prior to the opposing first cylindrical portions 274 making contact. This provides for no axial movement of bearing 66 and wheel 70 relative to bushings 268. This lack of axial movement of mid-rail wheel assembly 260 helps to eliminate racking of storage units 212 during movement.

Wheel 70 and track 24 are the same wheel and track which were described above and shown in FIGS. 3–6. The discussion of wheel 70 and track 24 and their relationship described in the first embodiment is applicable here also. The addition of mid-rail frame member 234 and mid-rail wheel assemblies 260 requires the addition of a third track 24 aligned with mid-rail frame member 234.

The operation of high density storage system 210 shown in FIG. 8–11 is identical to that shown in FIGS. 3–6 and described above. The above description of the operation of the storage system is also applicable here.

While the above detailed description describes the preferred embodiments of the present invention, it should be understood that the present invention is susceptible to modification, variation and alteration without deviating from the scope and fair meaning of the subjoined claims.

What is claimed is:

1. A movable storage system comprising:

at least one storage unit;

a plurality of track members extending between spaced apart locations;

a frame structure being formed by a plurality of longitudinal and lateral support members, said frame structure supporting each of said at least one storage unit and having a plurality of roller members supported by and operable to be guided by said track members to facilitate movement of said storage unit between said spaced apart locations, at least one of said plurality of roller members defining a generally U-shaped exterior surface having a pair of opposed annular surfaces, each of said pair of opposed annular surfaces engaging a respective longitudinally extending cylindrical guide; and said track members having a base and a plurality of longitudinally extending cylindrical guide members supported by said base, said plurality of roller members adapted to engage said cylindrical guide members.

2. A movable storage system as set forth in claim 1 wherein at least one of said plurality of longitudinal support members comprises a generally horizontal top portion and a generally vertical extending sidewall depending from said top portion.

3. A movable storage system as set forth in claim 1 wherein at least one of said plurality of lateral support members comprises a generally horizontal top portion and a pair of spaced vertically extending sidewalls depending from said top portion, said pair of spaced vertically extending sidewalls cooperating with said top portion to define an elongated channel extending between said side members.

4. A movable storage system as set forth in claim 3 wherein at least one of said plurality of roller members is supported for rotation within said elongated channel by an associated bearing shaft.

5. A movable storage system as set forth in claim 4 wherein at least one of said plurality of roller members is free to move axially relative to its associated bearing shaft within said elongated channel.

6. A movable storage system as set forth in claim 4 wherein at least one of said plurality of roller members is prohibited from moving axially relative to its associated bearing shaft within said elongated channel.

7. A movable storage system as set forth in claim 4 wherein each of said plurality of roller members is supported for rotation about its associated bearing shaft between said depending sidewalls of said lateral support member by a pair of bushing members carried upon its associated bearing shaft.

8. A movable storage system as set forth in claim 1 wherein said plurality of longitudinal support members is equal to two and said plurality of lateral support members is equal to two, and at least two of said plurality of roller members are disposed at locations along each of said lateral support members.

9. A movable storage system as set forth in claim 1 wherein said plurality of longitudinal support members is equal to two and said plurality of lateral support members is equal to three, and at least two of said plurality of roller members are disposed at locations along each of said lateral support members.

10. A movable storage system as set forth in claim 1 wherein one of said plurality of roller members is disposed at the junction between each of said lateral support members and said longitudinal support members.

11. A movable storage system as set forth in claim 11 wherein said generally U-shaped exterior surface has a pair of radially extending flanges which overlap said track member.

12. A movable storage system as set forth in claim 1 wherein said plurality of track members are flexible for mounting upon and conformable to an irregular surface.

13. A movable storage system comprising:

at least one storage unit;

a plurality of track members extending between spaced apart locations, said track members having a base and a plurality of longitudinally extending cylindrical guide members supported by said base;

a frame structure being formed by a pair of longitudinal support members and a pair of lateral support members, said frame structure supporting each of said at least one storage unit;

said pair of lateral support members each having a pair of roller members supported by and operable to be guided by said track members to facilitate movement of said storage unit between said spaced apart locations;

said roller members each defining a generally U-shaped exterior surface, said U-shaped exterior surface engaging said cylindrical guide members of said track members.

14. A movable storage system as set forth in claim 13 wherein said plurality of track members are flexible for mounting upon and conformable to an irregular surface.

15. A movable storage system as set forth in claim 13 wherein said generally U-shaped exterior surface has a pair of radially extending flanges which overlap said track member.

16. A movable storage system as set forth in claim 13 wherein said generally U-shaped exterior surface has a pair of opposed annular surfaces, each of said pair of opposed annular surfaces engaging a respective longitudinally extending cylindrical guide.

17. A movable storage system comprising:

at least one storage unit;

a plurality of track members extending between spaced apart locations, said track members having a base and a plurality of longitudinally extending cylindrical guide members supported by said base;

a frame structure being formed by a pair of longitudinal support members and three lateral support members, said frame structure supporting each of said at least one storage unit;

said three lateral support members each having a pair of roller members supported by and operable to be guided by said track members to facilitate movement of said storage unit between said spaced apart locations;

said roller members each defining a generally U-shaped exterior surface, said U-shaped exterior surface engaging said cylindrical guide members of said track members.

18. A movable storage system as set forth in claim 17 wherein said plurality of track members are flexible for mounting upon and conformable to an irregular surface.

19. A movable storage system as set forth in claim 17 wherein said generally U-shaped exterior surface has a pair of radially extending flanges which overlap said track member.

20. A movable storage system as set forth in claim 17 wherein said generally U-shaped exterior surface has a pair of opposed annular surfaces, each of said pair of opposed annular surfaces engaging a respective longitudinally extending cylindrical guide.

* * * * *

UNITED STATES PATENT AND TRADEMARK OFFICE

CERTIFICATE OF CORRECTION

PATENT NO. : 5,439,281

DATED : Aug. 8, 1995

INVENTOR(S) : John C. Croker

It is certified that error appears in the above-indentified patent and that said Letters Patent is hereby corrected as shown below:

Col. 2, Line 51, "storages" should be –storage–;

Col. 5, Line 62, "gusset 234" should be –gusset 240–;

Col. 6, Line 38, "Figure 8-11" should be –Figures 8-11–;

Col. 7, Line 49, Claim 11, "claim 11" should be –claim 1–;

Signed and Sealed this

Ninth Day of January, 1996

*Attest:*

Bruce Lehman

BRUCE LEHMAN

*Attesting Officer*

*Commissioner of Patents and Trademarks*